US007185695B1

(12) United States Patent
Santeler

(10) Patent No.: US 7,185,695 B1
(45) Date of Patent: Mar. 6, 2007

(54) INVESTMENT CASTING PATTERN MANUFACTURE

(75) Inventor: Keith A. Santeler, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 130 days.

(21) Appl. No.: 11/219,156

(22) Filed: Sep. 1, 2005

(51) Int. Cl.
*B22C 9/04* (2006.01)

(52) U.S. Cl. ..... 164/44; 164/45; 164/516

(58) Field of Classification Search ..... 164/44, 164/45, 516–519, 361, 369, 137, 342
See application file for complete search history.

(56) References Cited

U.S. PATENT DOCUMENTS

| | | | | |
|---|---|---|---|---|
| 6,637,500 | B2 | 10/2003 | Shah et al. | |
| 6,929,054 | B2 * | 8/2005 | Beals et al. | 164/369 |
| 2003/0155096 | A1 * | 8/2003 | Niimi et al. | 164/312 |

* cited by examiner

*Primary Examiner*—Kuang Y. Lin
(74) *Attorney, Agent, or Firm*—Bachman & LaPointe, P.C.

(57) ABSTRACT

At least one feed core and at least one wall cooling core are assembled with a number of elements of a die for forming a cooled turbine engine element investment casting pattern. A sacrificial material is molded in the die. The sacrificial material is removed from the die. The removing includes extracting a first of the die elements from a compartment in a second of the die elements before disengaging the second die element from the sacrificial material. The first element includes a compartment receiving an outlet end portion of a first of the wall cooling cores in the assembly and disengages therefrom in the extraction.

15 Claims, 6 Drawing Sheets

INVESTMENT CASTING PATTERN MANUFACTURE

U.S. GOVERNMENT RIGHTS

The invention was made with U.S. Government support under contract F33615-97-C-2779 awarded by the US Air Force. The U.S. Government has certain rights in the invention.

BACKGROUND OF THE INVENTION

The invention relates to investment casting. More particularly, the invention relates to investment casting of cooled turbine engine components.

Investment casting is a commonly used technique for forming metallic components having complex geometries, especially hollow components, and is used in the fabrication of superalloy gas turbine engine components.

Gas turbine engines are widely used in aircraft propulsion, electric power generation, ship propulsion, and pumps. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is typically provided by flowing relatively cool air, e.g., from the compressor section of the engine, through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

A well developed field exists regarding the investment casting of internally-cooled turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. In a shelling process, a ceramic shell is formed around one or more such patterns in well known fashion. The wax may be removed such as by melting in an autoclave. The shell may be fired to harden the shell. This leaves a mold comprising the shell having one or more part-defining compartments which, in turn, contain the ceramic core(s) defining the cooling passages. Molten alloy may then be introduced to the mold to cast the part(s). Upon cooling and solidifying of the alloy, the shell and core may be mechanically and/or chemically removed from the molded part(s). The part(s) can then be machined and/or treated in one or more stages.

The ceramic cores themselves may be formed by molding a mixture of ceramic powder and binder material by injecting the mixture into hardened metal dies. After removal from the dies, the green cores are thermally post-processed to remove the binder and fired to sinter the ceramic powder together. The trend toward finer cooling features has taxed ceramic core manufacturing techniques. The fine features may be difficult to manufacture and/or, once manufactured, may prove fragile. Commonly-assigned co-pending U.S. Pat. No. 6,637,500 of Shah et al. discloses exemplary use of a ceramic and refractory metal core combination. Other configurations are possible. Generally, the ceramic core(s) provide the large internal features such as trunk passageways while the refractory metal core(s) provide finer features such as outlet passageways. Assembling the ceramic and refractory metal cores and maintaining their spatial relationship during wax overmolding presents numerous difficulties. A failure to maintain such relationship can produce potentially unsatisfactory part internal features. Depending upon the part geometry and associated core(s), it may be difficult to assembly fine refractory metal cores to ceramic cores. Once assembled, it may be difficult to maintain alignment. The refractory metal cores may become damaged during handling or during assembly of the overmolding die. Assuring proper die assembly and release of the injected pattern may require die complexity (e.g., a large number of separate die parts and separate pull directions to accommodate the various RMCs). U.S. patent application Ser. No. 10/867,230, by Carl Verner et al. filed Jun. 14, 2004 and entitled INVESTMENT CASTING, discloses the pre-embedding of RMCs in wax bodies shaped to help position the core assembly and facilitate die separation and pattern removal.

SUMMARY OF THE INVENTION

One aspect of the invention involves a method for manufacturing a cooled turbine engine element investment casting pattern. At least one feed core and at least one airfoil wall cooling core are assembled with a number of elements of a die. A sacrificial material is molded in the die and is then removed from the die. The removing includes extracting a first of the die elements from a compartment in a second of the die elements before disengaging the second die element from the sacrificial material. The first element includes a compartment receiving an outlet end portion of a first of the wall cooling cores in the assembly and disengages therefrom in the extraction.

In various implementations, the disengaging of the second element from the sacrificial material may include a first extraction in a first direction. The extracting of the first die element may be in a second direction off-parallel to the first direction. The first extraction may release a backlocking between the first wall cooling core and the second element. The second direction may be off-parallel to the first direction by 5–60°.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
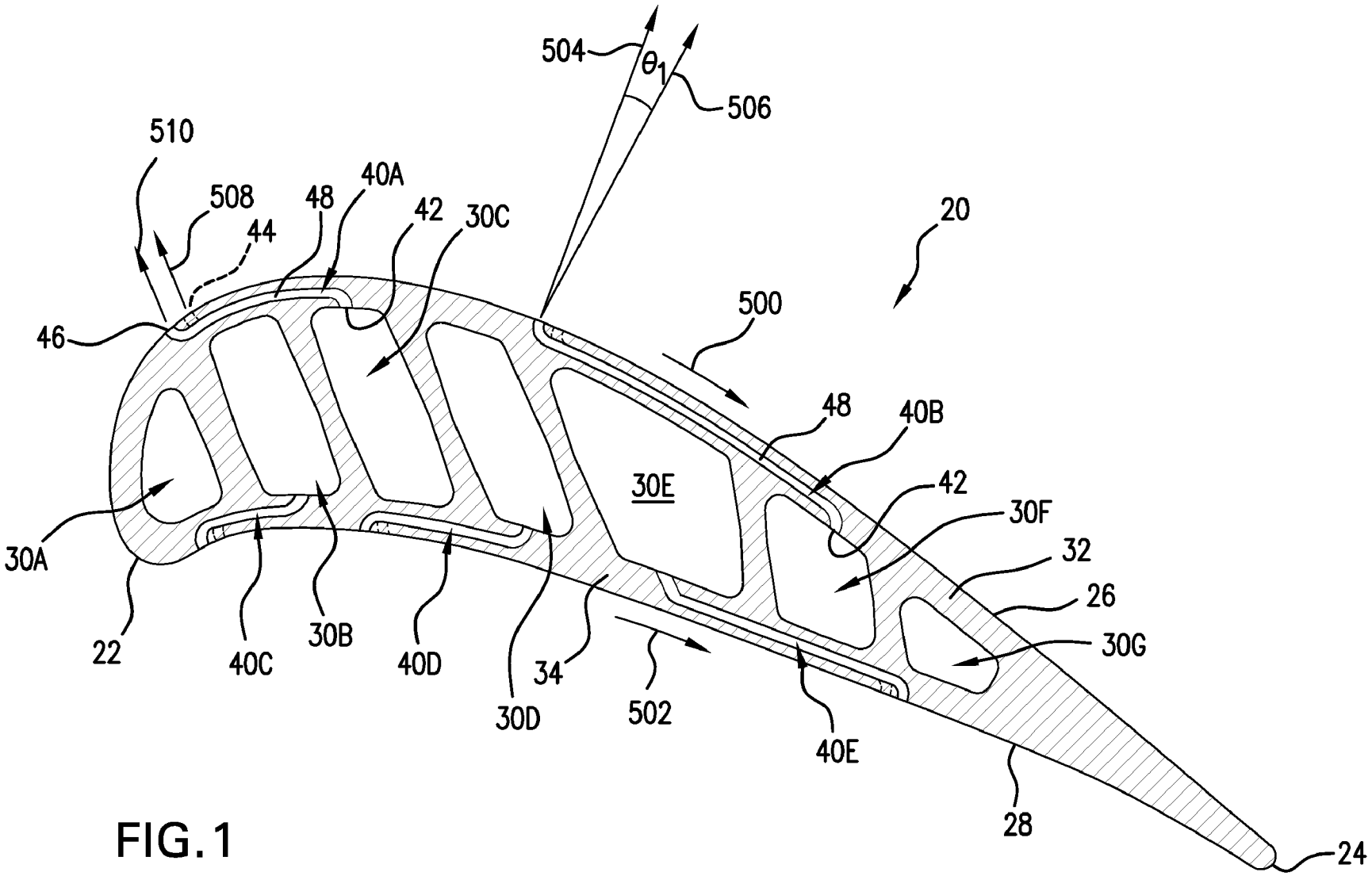
FIG. 1 is a streamwise sectional view of a turbine airfoil element.

FIG. 1 shows an exemplary airfoil 20 of a gas turbine engine element. An exemplary element is a blade wherein the airfoil is unitarily cast with an inboard platform and attachment root for securing the blade to a disk. Another example is a vane wherein the blade is unitarily cast with an outboard shroud and, optionally, an inboard platform. Other examples include seals, combustor panels, and the like. The exemplary airfoil 20 has a leading edge 22 and a trailing edge 24. A generally convex suction side 26 and a generally concave pressure side 28 extend between the leading and trailing edges. In operation, an incident airflow is split into portions 500 and 502 along the suction and pressure sides (surfaces) 26 and 28, respectively.

The exemplary airfoil 20 includes an internal cooling passageway network. An exemplary network includes a plurality of spanwise extending passageway legs 30A–30G from upstream to downstream. These legs carry one or more flows of cooling air (e.g., delivered through the root of a blade or the shroud of a vane). Outboard of the legs, the airfoil has suction and pressure side walls 32 and 34. To cool the walls 32 and 34, the passageway network includes cooling circuits 40A–40E each extending from one or more of the passageway legs 30A–30G to the suction or pressure sides.

In the example of FIG. 1, there are two circuits along the suction side: an upstream circuit 40A; and a downstream circuit 40B. There are three circuits along the pressure side: an upstream circuit 40C; an intermediate circuit 40D; and a downstream circuit 40E. Although not shown, there may be a circuit extending from the downstreammost leg 30G to or near to the trailing edge 24. There may also be additional circuits along a leading portion of the airfoil. Each of the circuits 40A–40E has one or more inlets 42 at the associated passageway leg or legs. As is discussed in further detail below, in the exemplary airfoil, the inlets 42 of each circuit are formed as a single spanwise row of inlets. With multiple spanwise rows, however, other configurations are possible including the feeding of a given circuit from more than one of the legs. Each circuit extends to associated outlets. In the exemplary airfoil, each circuit extends to two rows of outlets 44 and 46. As is discussed in further detail below, the exemplary outlets of each row are streamwise staggered. Between the inlets and outlets, a main portion 48 of each circuit may extend through the associated wall 32 or 34 in a convoluted fashion.

In the exemplary airfoil, the circuits 40A–40D are oriented as counterflow circuits (i.e., airflow through their main portions 48 is generally opposite the adjacent airflow 500 or 502) to form counterflow heat exchangers. The exemplary circuit 40E is positioned for parallel flow heat exchange to form a parallel flow heat exchanger. In the exemplary circuits, the outlets are angled slightly off-normal to the surface 26 or 28 in a direction with the associated flow 500 or 502. For example, FIG. 1 shows a local surface normal 504 and an axis 506 of the outlets separated by an angle $\theta_1$. This angle helps enhance flow through the circuit by improving entrainment of the outlet flows 508 and 510 (shown exaggerated). The angle may also help provide a film cooling effect on the surface to the extent the cool from the flows 508 and 510 air stays closer to the surface.

An investment casting process is used to form the turbine element. In the investment casting process, a sacrificial material (e.g., a hydrocarbon based material such as a natural or synthetic wax) is molded over a sacrificial core assembly. The core assembly ultimately forms the passageway network. After shelling of the pattern (e.g., by a multi-stage stuccoing process) and removal of the wax (e.g., by a steam autoclave) metal is cast in the shell. Thereafter, the shell and core assembly are removed from the casting. For example, the shell may be mechanically broken away and the core assembly may be chemically leached from the casting.

Figure 2:
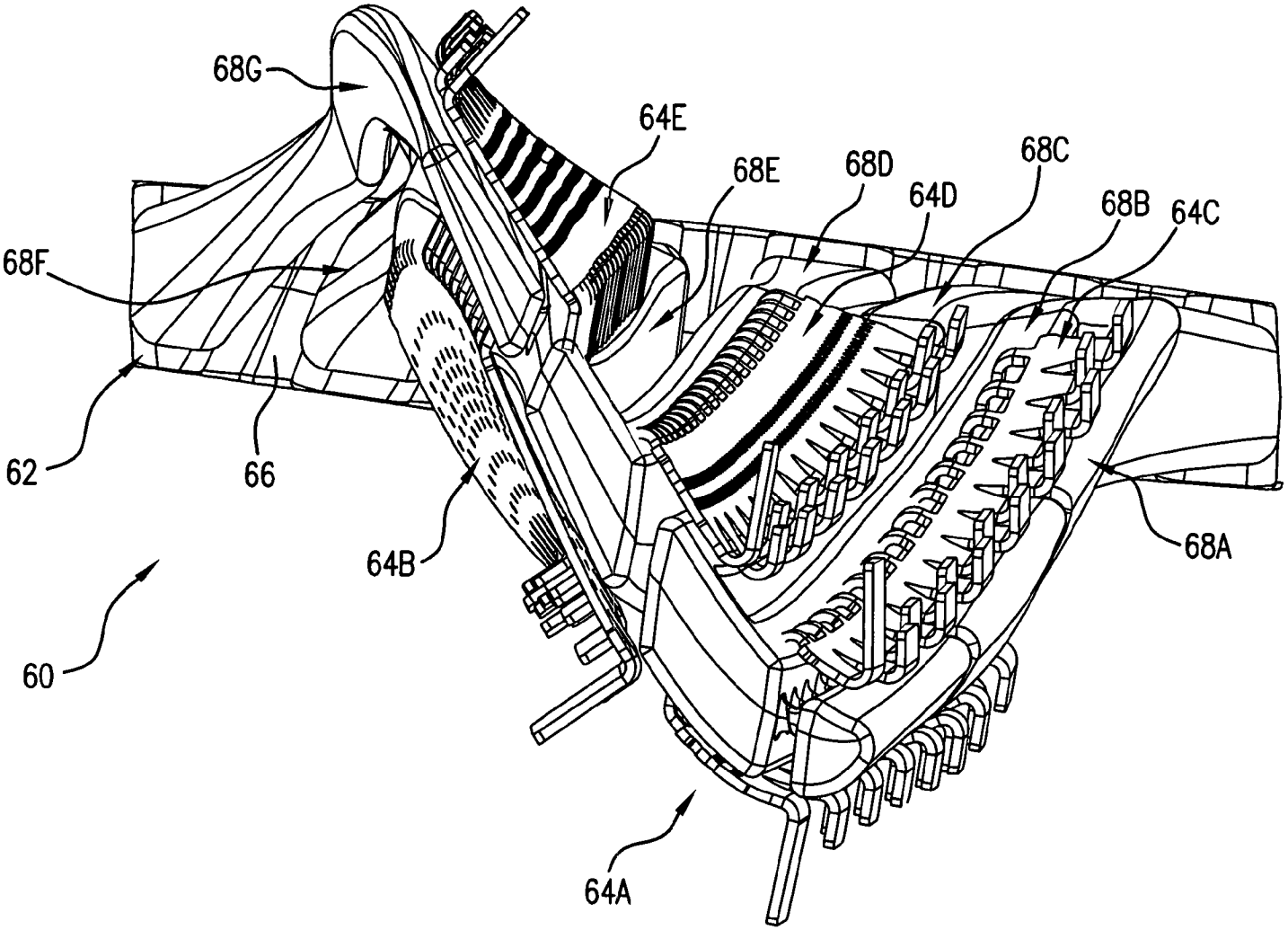
FIG. 2 is a tip-end view of a core assembly for forming the element of FIG. 1.

FIG. 2 shows an exemplary investment casting core assembly 60. The assembly includes one or more ceramic cores, illustrated in FIG. 2 as a single ceramic feed core 62, and a number of refractory metal cores (RMCs) 64A–64E. Exemplary RMCs are formed from molybdenum sheet stock and may have a protective coating (e.g., ceramic). Alternative RMC substrate materials include refractory metal-based alloys and intermetallics. As is discussed below, the RMCs 64A–64E respectively form the circuits 40A–40E in the cast part. The feed core 62 includes a proximal root 66 and a series of spanwise portions 68A–68G. The spanwise portions respectively form the passageways 30A–30G in the cast part.

Each of the exemplary RMCs (FIG. 3) includes a main body 80. The body 80 has first and second faces 82 and 84 and may have a number of apertures 86 for forming pedestals, dividing walls, or other features in the associated circuit 40A–40E. The body extends between first and second spanwise ends 88 and 90 and from an inlet end 92 to an outlet end 94. At the inlet end, an array of tabs 96 extend from the body 80. The tabs have proximal portions 98 bent/curved to orient the tab away from the local orientation of the body 80. Exemplary tabs 96 have straight terminal portions 100 extending to distal ends 102. When assembled to the feed core 62, the distal ends 102 engage the feed core (e.g., contacting a surface of or received within a compartment of the associated spanwise portion(s) 68A–68G).

Similarly, at the outlet end 94, first and second arrays of tabs 110 and 112, respectively, extend from the body 80. The tabs 110 and 112 have proximal portions 114 and 116, respectively, bent/curved to orient the tab away from the local orientation of the body 80. The exemplary tabs 110 and 112 have straight terminal portions 118 and 120, respectively, extending to distal ends 122 and 124. When assembled to the feed core 62, the distal ends 122 and 124 are positioned to engage a die assembly (discussed below) for molding the pattern wax over the core assembly. In the pattern and cast part, the tabs 96 form the circuit inlets 42 and the tabs 110 and 112 form the circuit outlets 44 and 46, respectively.

Figure 3:
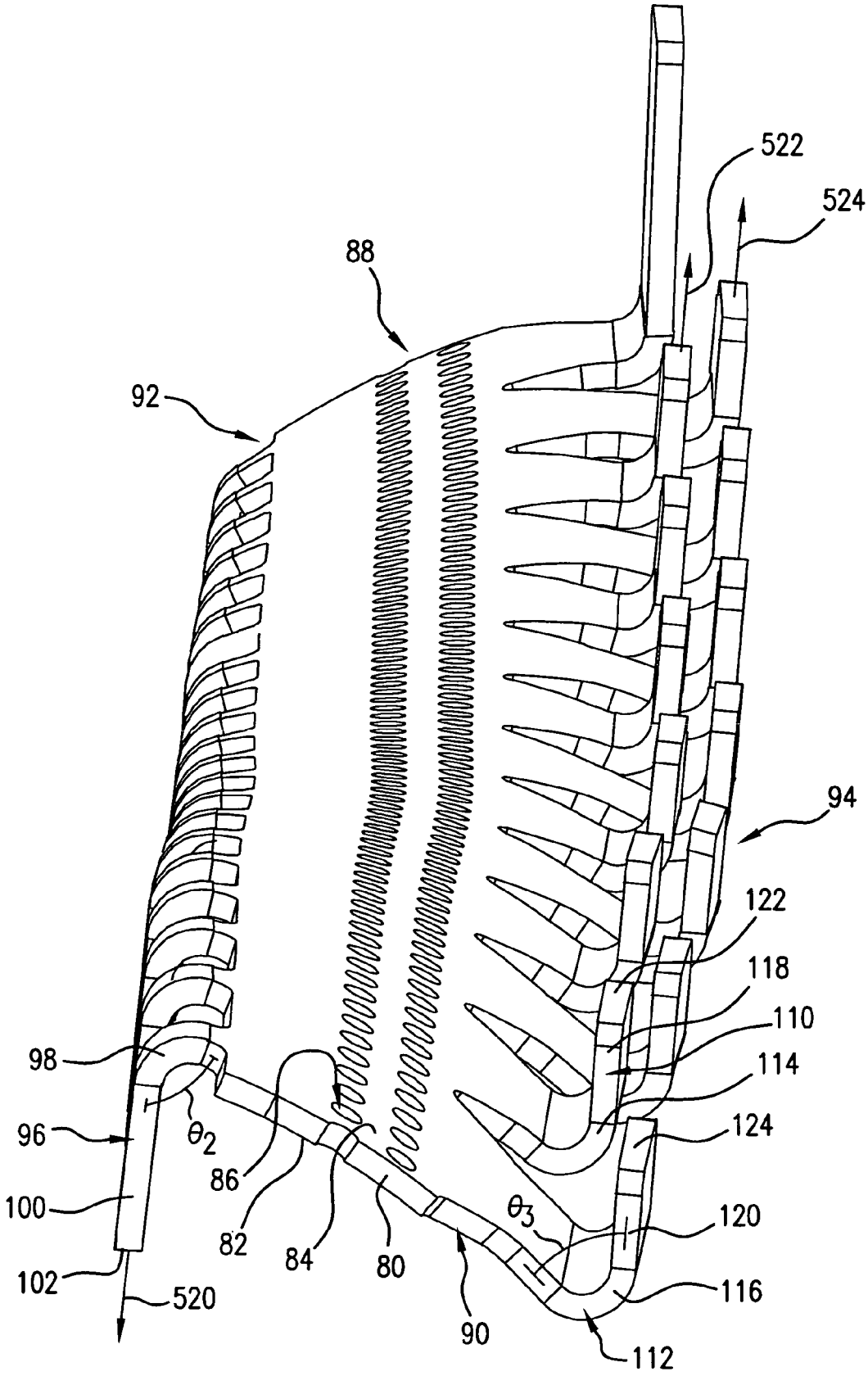
FIG. 3 is a view of a refractory metal core of the assembly of FIG. 2.
Figure 5:
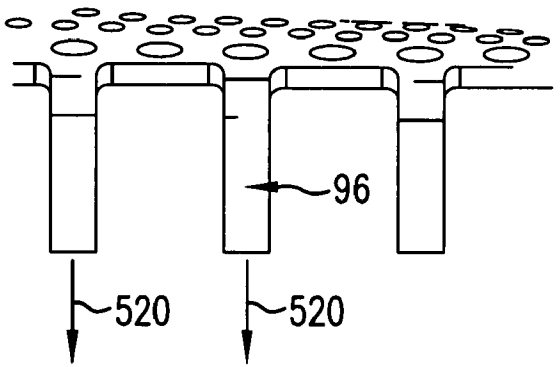
FIG. 5 is an inlet end view of the RMC of FIG. 4.
Figure 4:
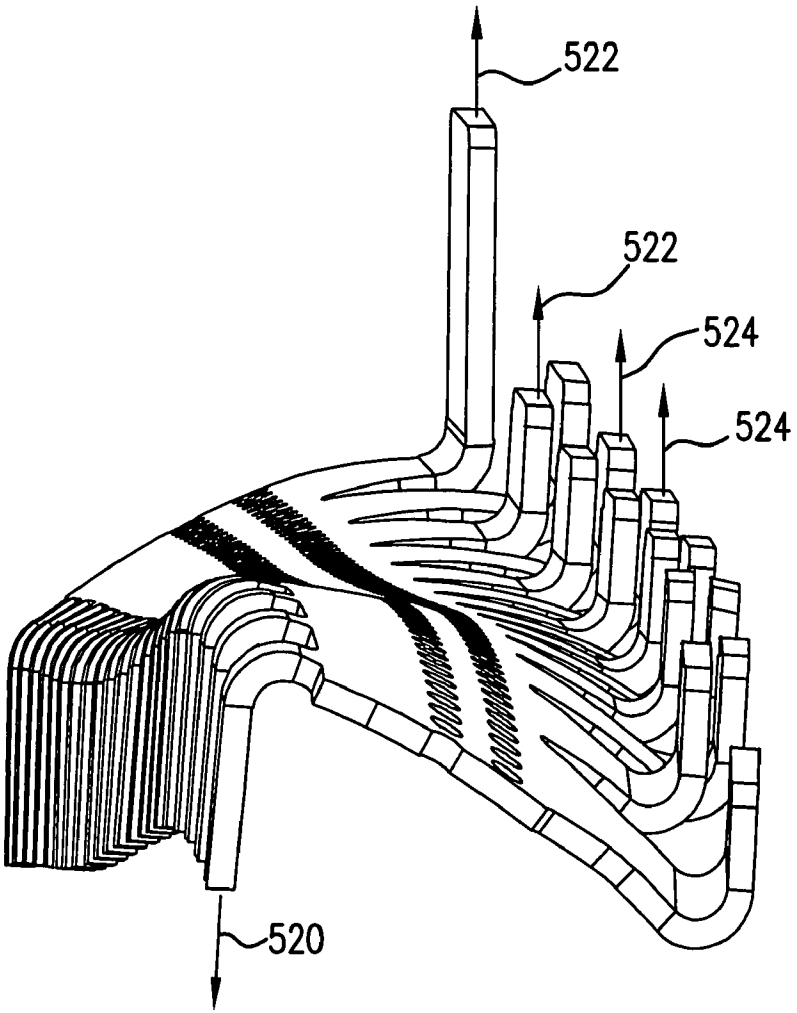
FIG. 4 is an end view of the refractory metal core of FIG. 3.

As is discussed in further detail below, the terminal portions 100 of the tabs 96 have central axes 520. The terminal portions 118 and 120 of the tabs 110 and 112 have respective central axes 522 and 524. FIG. 4 shows the exemplary axes 522 as parallel to each other in spanwise projection. Similarly, the exemplary axes 524 are parallel to each other in spanwise projection. In the exemplary embodiment, the axes 522 and 524 are also parallel to each other. Similarly, the exemplary axes 520 are parallel to each other. The axes may be fully parallel to each other (e.g., not merely in a spanwise projection). For example, FIG. 5 shows the tabs 96 as parallel when viewed approximately streamwise. FIG. 3 also shows the terminal portions 100 of the tabs 96 at an angle $\theta_2$ to the adjacent portion of the main body 80. The terminal portions 118 and 120 of the tabs 110 and 112 are shown at an angle $\theta_3$ to the adjacent portion of the main body 80. The exemplary main body 80 is curved (e.g., having appropriate streamwise convexity or concavity for the suction or pressure side, respectively, and having appropriate twist for that side). Accordingly, $\theta_2$ and $\theta_3$ may vary spanwise. For example, they may be well under 90° at one spanwise end, transitioning to over 90° at the other. Exemplary low values for $\theta_3$ are less than 80°, more particularly about 30–75° or 40–70°. Exemplary larger values are the supplements (180°—x) of these. For some embodiments exemplary $\theta_1$ are 15–60°.

Figure 6:
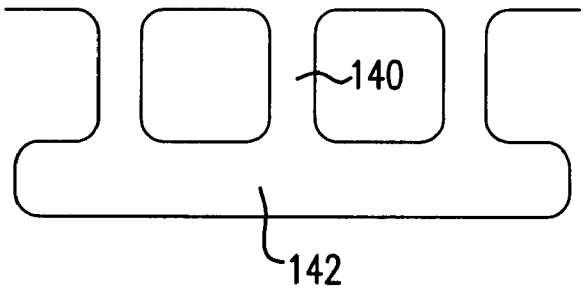
FIG. 6 is an inlet end view of an alternate refractory metal core.

FIG. 6 shows an alternate group of tabs 140 connected by a terminal bridging portion 142 (e.g., distinguished from the free tips of other tabs). This construction may provide greater handling robustness.

Figure 7:
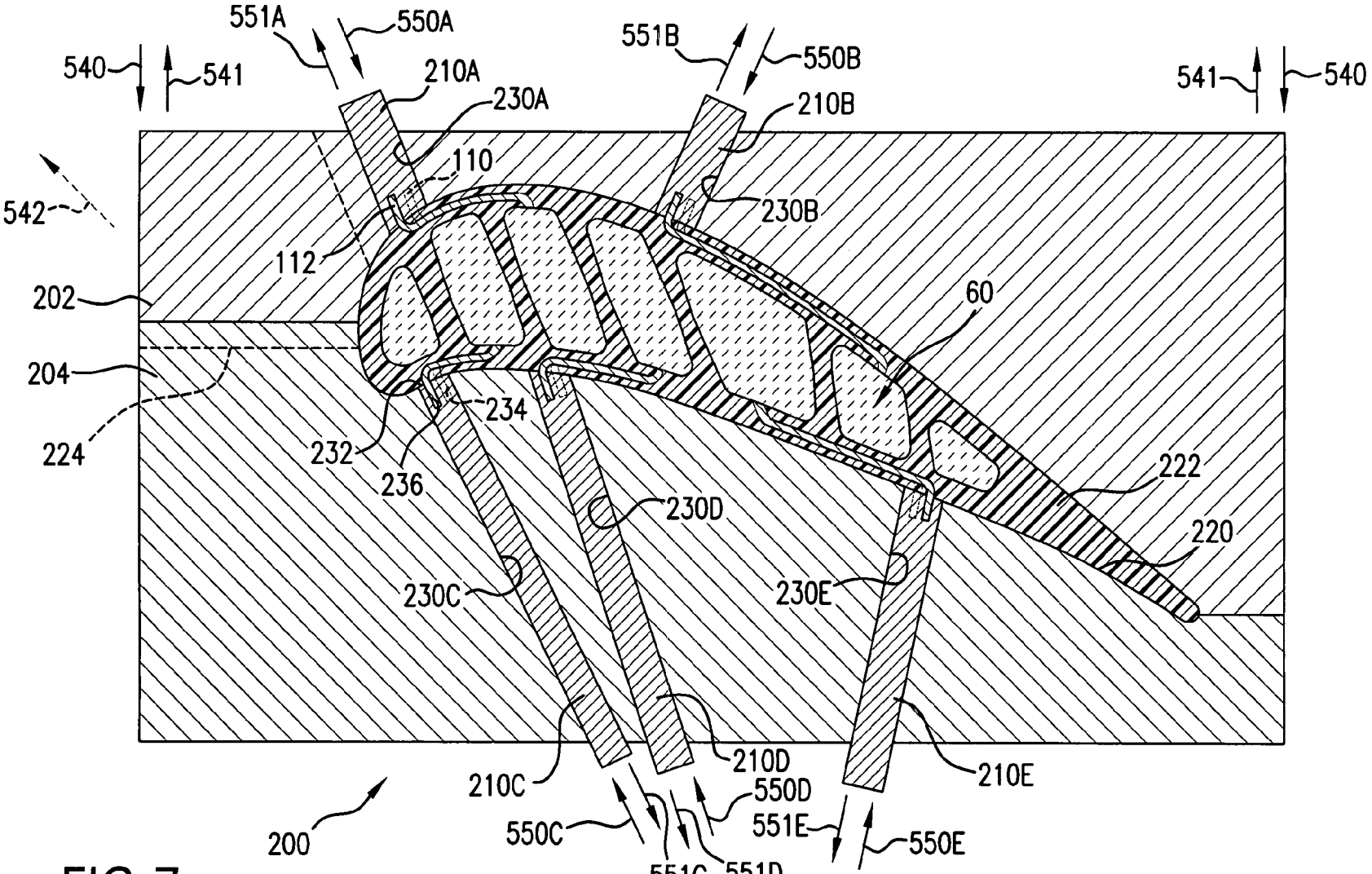
FIG. 7 is a streamwise sectional view of a pattern-forming die.

The parallelism of the outlet tabs (or of groups of the outlet tabs—FIG. 8 below) may facilitate pattern manufacture. FIG. 7 shows a pattern-forming die assembly 200. The assembly 200 includes two or more die main elements 202 and 204. The assembly 200 also includes a number of die inserts 210A–210E, each carried by an associated one of the die main elements 202 or 204. The die assembly defines an internal surface 220 forming a compartment for containing the core assembly 60 and molding the pattern wax 222 over the core assembly 60.

For ease of reference, the die main elements 202 and 204 may be respectively identified as upper and lower die elements, although no absolute orientation is required. In general, such die elements are installed to each other by a linear insertion in a direction 540 and, after molding, are separated by extraction in an opposite direction 541. With two such main elements, this extraction is known as a single pull. However, some pattern configurations do not permit single pull molding because the shape of the molded wax may create a backlocking effect. In such a situation, there may be an additional main element. FIG. 7 shows, in broken line, such an additional element 224 and its associated pull direction 542.

Use of the RMCs presents additional backlocking considerations. Specifically, the tabs, if not oriented parallel to the pull of the associated die main element, may cause backlocking. To decouple tab orientation from the associated die main element pull direction, the assembly 200 utilizes the inserts 210A–210E. Each of the inserts 210A–210E is received in an associated compartment 230A–230E in the associated die main element 202 or 204. Each insert 210A–210E includes an end surface 232 which ultimately forms a part of the surface 220. Extending inward from the surface 232 are rows of compartments 234 and 236. The compartments 234 and 236 are positioned to receive the terminal portions of the associated outlet tabs 110 and 112.

It can be seen in FIG. 7 that with the inserts 210A–210E in place, the RMCs backlock the upper die half 202 against extraction in the direction 541. A similar result would occur in the absence of the inserts (i.e., if the inserts were unitarily formed with their associated die halves). One alternative to prevent such backlocking would be to orient the terminal portions 118 and 120 parallel to the direction of extraction 541. However, this orientation could either reduce flexibility in selecting the outlet orientation or impose manufacturing difficulties.

Accordingly, in an exemplary method of manufacture, the RMCs may be preassembled to the feedcore. The RMCs may be positioned relative to the feedcore such as by wax pads (not shown) between the RMC main bodies and the feedcore. The RMCs may be secured to the feedcore such as by melted wax drops or a ceramic adhesive along the contact region between the RMC inlet end terminal portions 100 and the feedcore. The die main elements are initially assembled around the core assembly 60 with the inserts 210A–210E fully or slightly retracted. The inserts 210A and 210E are, then, inserted in respective directions 550A–550E. During the insertion, the terminal portions 118 and 120 of each RMC are received by the associated compartments 234 and 236 of the associated insert 210A–210E. After introduction of the wax 222, the inserts 210A–210E may be fully or partially retracted (e.g. the retraction consisting essentially of a linear extraction) in a direction 551A–551E, opposite the associated direction 550A–550E. The retraction may be simultaneous or staged. In one exemplary staged retraction, the inserts in one of the die halves (e.g., 210A and 210B in the upper die half 202) are first retracted while the other inserts 210C–210E remain in place. The upper die half 202 may then be disengaged from the lower die half 204 and pattern by extraction in the direction 541. During this extraction, the backlocking of the inserts 210C–210E to their associated RMCs helps maintain the pattern engaged to the lower die half. Thereafter, the inserts 210C–210E may be retracted to permit removal of the pattern from the lower die half (e.g., by lifting the pattern in the direction 541).

Figure 8:
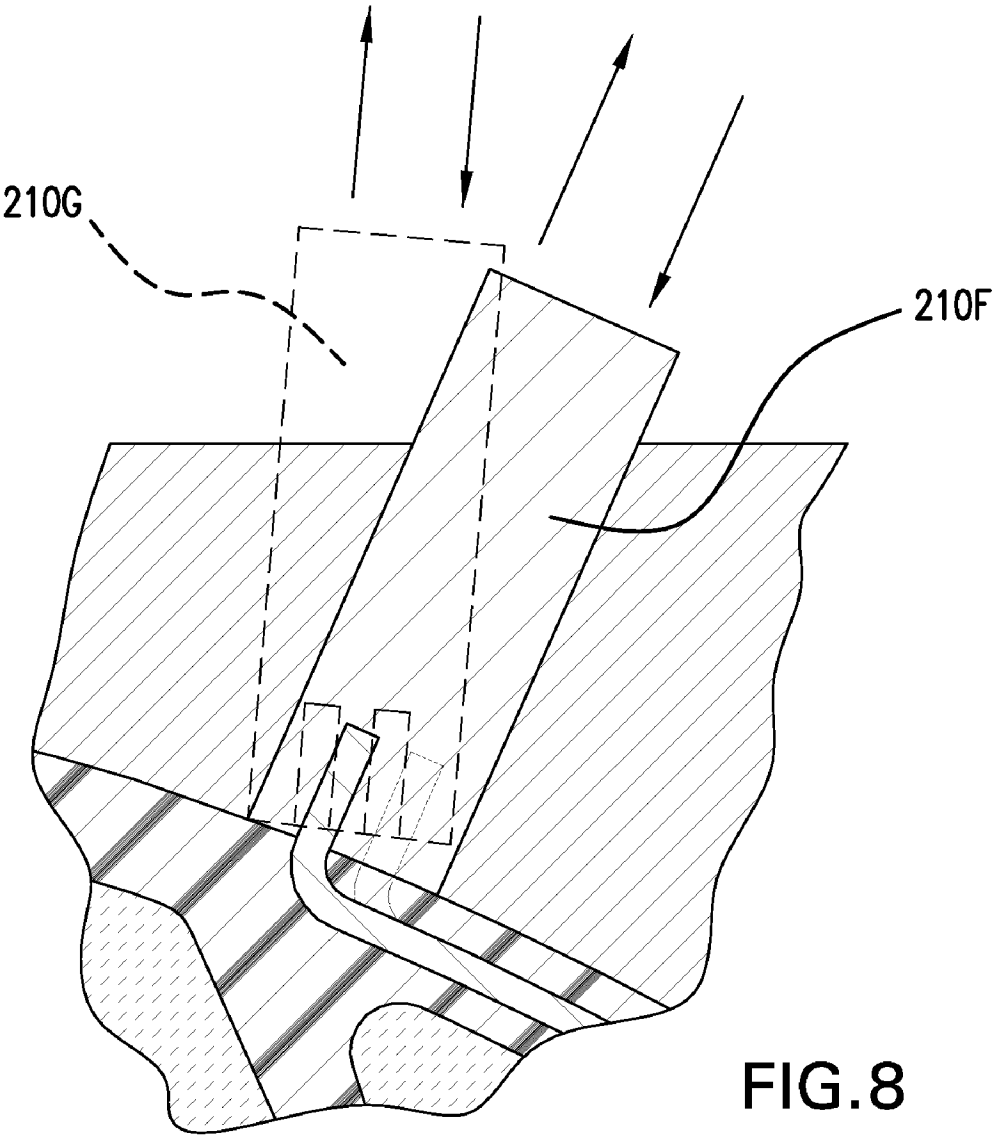
FIG. 8 is a partial streamwise sectional view of an alternate pattern forming die.

FIG. 8 shows an alternate pattern forming die otherwise similar to that of FIG. 7 but wherein the element 210B is replaced by a pair of elements 210F and 210G. Each of the elements 210F and 210G includes compartment(s) respectively receiving first and second pluralities of tabs from each of the rows of outlet tabs of the associated RMC.

One or more embodiments of the present invention have been described. Nevertheless, it will be understood that various modifications may be made without departing from the spirit and scope of the invention. For example, details of the particular parts being manufactured may influence details of any particular implementation. Also, if implemented by modifying existing equipment, details of the existing equipment may influence details of any particular implementation. Accordingly, other embodiments are within the scope of the following claims.

What is claimed is:

1. A method for manufacturing a cooled turbine engine element investment casting pattern comprising:

assembling at least one feed core and at least one wall cooling core with a plurality of elements of a die;

molding a sacrificial material in the die; and removing the sacrificial material from the die, wherein the removing comprises:

extracting a first of the die elements from a compartment in a second of the die elements before disengaging the second element from the sacrificial material, the first element including a compartment receiving an outlet end portion of a first of the wall cooling cores in the assembling and disengaging therefrom in the extracting, the extracting of the first die element releasing a backlocking between the first wall cooling core and the second element.

2. The method of claim 1 used to manufacture an airfoil element wherein the wall cooling core is an airfoil cooling core.

3. The method of claim 1 wherein:

the outlet end portion comprises a first plurality of tabs from a first row of tabs; and a third of the die elements includes a compartment receiving a second plurality of tabs from the first row of tabs in an assembling and disengaging therefrom in an extracting.

4. The method of claim 1 wherein:

the disengaging the second element from the sacrificial material comprises a first extraction in a first direction; and the extracting the first die element is in a second direction off-parallel to the first direction.

5. The method of claim 4 wherein:

the second direction is off-parallel to the first direction by 5–60°.

6. The method of claim 1 wherein:

the outlet end portion comprises a plurality of outlet-forming tabs; and the first element comprises a plurality of compartments for receiving associated ones of the tabs.

7. The method of claim 6 wherein:

the plurality of outlet-forming tabs are arranged in first and second rows; and the first element receives at least some of the tabs of both said first and second rows.

8. The method of claim 1 wherein the removing comprises:

extracting a third of the die elements from a compartment in a fourth of the die elements before disengaging the fourth element from the sacrificial material, the third element including a compartment receiving an outlet end portion of the a second of the wall cooling cores in the assembling and disengaging therefrom in the extracting of the third die element.

9. The method of claim 8 wherein:

the disengaging the fourth element from the sacrificial material comprises extraction opposite the first direction; and the extracting the third die element is in a third direction off-parallel to the first direction.

10. The method of claim 1 wherein:

the sacrificial material comprises a wax;

the at least one feed core comprises a first ceramic feed core;

the first wall cooling core comprises a refractory metal-based substrate.

11. The method of claim 1 wherein:

the first wall cooling core is positioned to form a counterflow heat exchanger.

12. The method of claim 11 wherein:

the outlet end portion is oriented to form outlet slots inclined 15–60° off normal to an adjacent surface.

13. The method of claim 1 wherein:

the first wall cooling core is positioned to form a parallel flow heat exchanger.

14. The method of claim 1 wherein:

the extracting consists essentially of a linear extraction.

15. The method of claim 1 wherein removing comprises:

extracting a third of the die elements from a compartment in a second of the die elements before disengaging the second element from the sacrificial material, the third element including a compartment receiving an outlet end portion of a second of the wall cooling cores in the assembling and disengaging therefrom in the extracting of the third die element, the extracting of the third die element releasing a backlocking between the second wall cooling core and the second element.

* * * * *